US008627545B2

(12) United States Patent
Streciwilk

(10) Patent No.: US 8,627,545 B2
(45) Date of Patent: Jan. 14, 2014

(54) VACUUM CLEANER WITH ENHANCED MANEUVERABILITY

(75) Inventor: Eric J. Streciwilk, Danville, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 311 days.

(21) Appl. No.: 13/051,613

(22) Filed: Mar. 18, 2011

(65) Prior Publication Data

US 2012/0233806 A1 Sep. 20, 2012

(51) Int. Cl.
*A47L 9/00* (2006.01)

(52) U.S. Cl.
USPC ..... 15/411; 15/351

(58) Field of Classification Search
USPC ..... 15/411, 410, 415.1, 350, 351, 414
See application file for complete search history.

(56) References Cited

U.S. PATENT DOCUMENTS

| | | | | |
|---|---|---|---|---|
| 2,974,347 | A | 3/1961 | Seyfried | |
| 5,323,510 | A | 6/1994 | Redding et al. | |
| 5,584,095 | A | 12/1996 | Redding et al. | |
| 5,794,305 | A | 8/1998 | Weger | |
| 6,055,703 | A | 5/2000 | Redding et al. | |
| 6,277,164 | B1 | 8/2001 | Embree et al. | |
| 7,383,608 | B2 | 6/2008 | Odachi et al. | |
| 7,581,284 | B2 | 9/2009 | Courtney | |
| 7,600,292 | B2 | 10/2009 | Courtney | |
| 7,607,196 | B2 | 10/2009 | Li | |
| 7,610,653 | B2 | 11/2009 | Courtney | |
| 7,757,343 | B2 | 7/2010 | Courtney | |
| 7,950,102 | B2 * | 5/2011 | Lee et al. | 15/327.4 |
| 8,347,454 | B2 * | 1/2013 | Ashbee et al. | 15/351 |
| 2008/0115313 | A1 | 5/2008 | Dyson et al. | |
| 2008/0222840 | A1 | 9/2008 | Worker et al. | |
| 2009/0056056 | A1 | 3/2009 | Liebig et al. | |
| 2009/0056058 | A1 | 3/2009 | Finke et al. | |
| 2009/0056061 | A1 | 3/2009 | Andrup et al. | |
| 2009/0056063 | A1 | 3/2009 | Poetting | |
| 2009/0056064 | A1 | 3/2009 | Finke et al. | |
| 2009/0056065 | A1 | 3/2009 | Finke | |
| 2009/0165242 | A1 * | 7/2009 | Lee et al. | 15/411 |
| 2009/0300875 | A1 | 12/2009 | Inge et al. | |
| 2009/0313786 | A1 | 12/2009 | Cookson | |
| 2010/0095477 | A1 | 4/2010 | Worker et al. | |

FOREIGN PATENT DOCUMENTS

| | | | |
|---|---|---|---|
| GB | 2453616 | A | 4/2009 |
| GB | 2456195 | A | 7/2009 |

OTHER PUBLICATIONS

Search and Examination Report for Application No. GB1202679.5 dated Jun. 18, 2012.

* cited by examiner

*Primary Examiner* — Dung Van Nguyen
(74) *Attorney, Agent, or Firm* — King & Schickli, PLLC

(57) ABSTRACT

An upright vacuum cleaner has a body including a nozzle assembly and a handle assembly. A suction generator and dirt collection vessel are carried on the body. A dual pivot connector connects the handle assembly with the nozzle assembly. The connector provides a first pivotal connection between the connector and the nozzle assembly and a second pivotal connection between the connector and the handle assembly. In addition a tilt handle assembly is connected to the body by a third pivotal connection.

24 Claims, 17 Drawing Sheets

Fig. 6
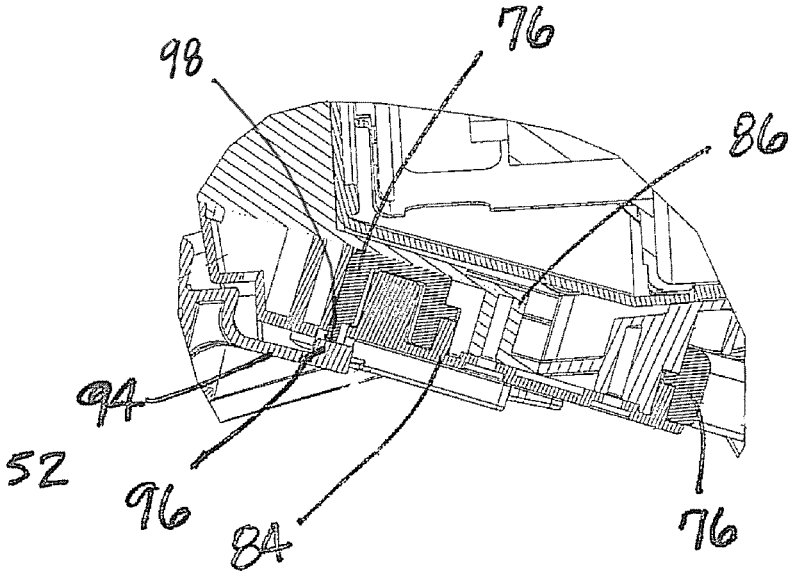
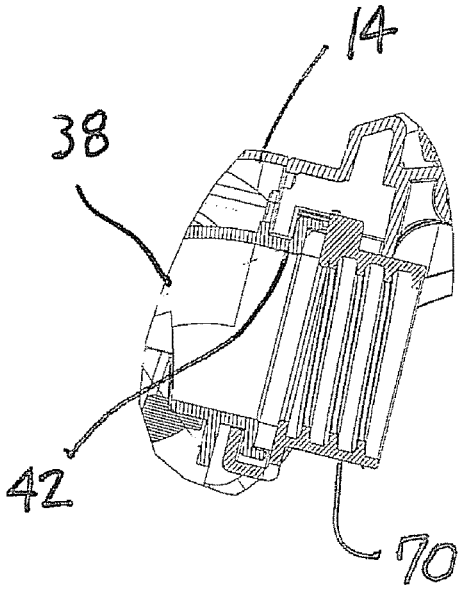
Fig. 8

VACUUM CLEANER WITH ENHANCED MANEUVERABILITY

TECHNICAL FIELD AND INDUSTRIAL APPLICABILITY OF THE INVENTION

The present invention relates generally to the floor care equipment field and, more particularly, to a new and improved vacuum cleaner designed to provide enhanced maneuverability during operation.

BACKGROUND OF THE INVENTION

Upright vacuum cleaners have long been known in the art. Such vacuum cleaners generally include a nozzle assembly with a suction inlet and an optional rotary agitator. A handle assembly is pivotally connected to the nozzle assembly. The handle assembly usually includes the control handle or stalk and typically houses both the dirt collection vessel and the suction generator. However, either or both of the dirt collection vessel and suction generator may be provided on the nozzle assembly if desired.

In operation, the operator inclines the handle assembly and control handle from an upright storage position and pushes and pulls the vacuum cleaner to and fro over the surface to be cleaned. Generally, some effort is required to turn the vacuum cleaner left and right in order to guide it over the floor as necessary to complete the cleaning operation. This is particularly true in tight areas such as in room corners or when cleaning around furniture.

It has been recognized that it is desirable to reduce the effort required to turn and maneuver the vacuum cleaner during the cleaning operation. Several design modifications have been proposed to meet this end. One of the most recent, is disclosed in U.S. Pat. No. 7,600,292. Specifically, the upright vacuum cleaner is equipped with a roller assembly or ball instead of individual rear wheels. The roller assembly may be substantially spherical in shape with truncated faces at opposed ends. The curved outer surface causes the control handle to tilt to one side or the other to aid in turning the vacuum cleaner right or left as desired. While this design improves maneuverability, there are significant trade-offs. For example, the suction motor is positioned inside the roller assembly. This high speed motor produces substantial torque that interferes with the smooth turning operation of the device. Further, the resulting vacuum cleaner is somewhat unstable and requires a retractable stand to support the control handle and handle assembly in an upright storage position. The stand has a flimsy, awkward appearance and provides minimum functionality that does not inspire confidence in the user.

The present invention relates to a new and improved vacuum cleaner designed to provide enhanced maneuverability while avoiding detrimental performance tradeoffs associated with the prior art design. Advantageously, the maneuverability enhancements are achieved in a compact design of high reliability that may be produced at a competitive cost.

SUMMARY OF THE INVENTION

In accordance with the purposes and advantages as described herein a novel upright vacuum cleaner is provided. The upright vacuum cleaner comprises a body including a nozzle assembly and a handle assembly. A connector connects the handle assembly and the nozzle assembly. The connector provides a first pivotal connection between the connector and the nozzle assembly and a second pivotal connection between the connector and the handle assembly. Both a suction generator and a dirt collection vessel are carried on the body. In addition, a tilt axle assembly is connected to the body by a third pivotal connection.

The first pivotal connection has a first pivot axis and the second pivotal connection has a second pivot axis. The third pivotal connection has a third pivot axis. Further, the handle assembly has a longitudinal axis. The longitudinal axis of the handle and the third pivot axis form an included angle of between about 10 and about 30 degrees.

In the following description there is shown and described several different embodiments of the invention, simply by way of illustration of some of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated herein and forming a part of the specification, illustrate several aspects of the present invention and together with the description serve to explain certain principles of the invention. In the drawings:

FIG. 6 is a detailed cross sectional view through the nozzle assembly and the pivotal connection between the tilt axle assembly and the bottom of the handle assembly;

FIG. 8 is a detailed cross sectional view illustrating the pivotal connection between the yolk and the nozzle assembly;

FIGS. 9*a* and 9*b* are detailed elevational views illustrating the mechanism for centering the handle assembly as it is moved into the upright storage position;

Figure 1:
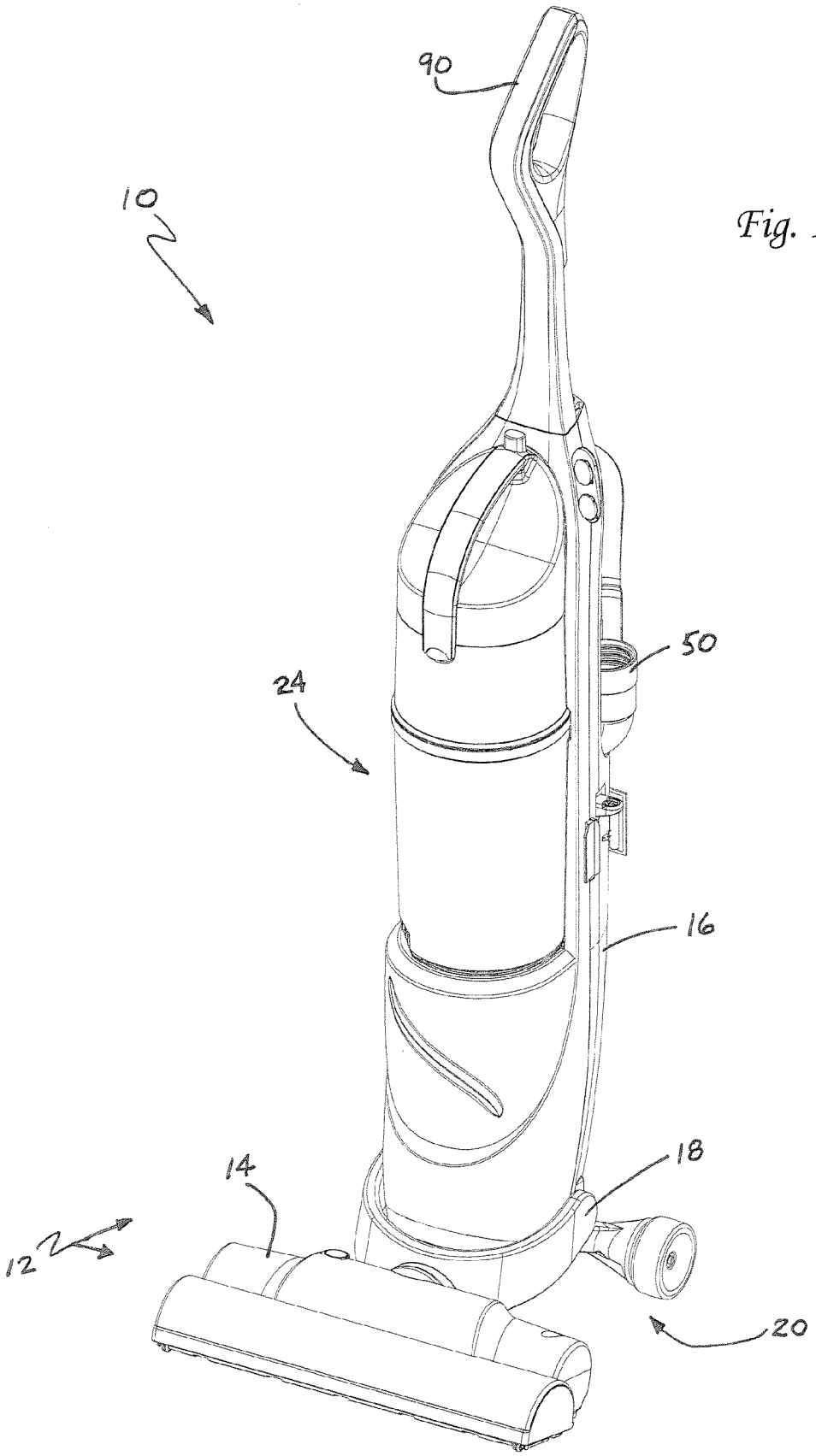
FIG. 1 is a perspective view of the vacuum cleaner.

Reference will now be made in detail to the present preferred embodiment of the invention, examples of which are illustrated in the accompanying drawings.

DETAILED DESCRIPTION OF THE PREFERRED EMBODIMENTS OF THE INVENTION

Reference is now made to FIGS. 1, 2, 3, 4*a* and 4*b* illustrating an upright vacuum cleaner 10 having a body 12 including a nozzle assembly 14 and a handle assembly 16. A connector 18, which will be described in greater detail below, pivotally connects the handle assembly 16 to the nozzle assembly 14. In addition, a tilt axle assembly, generally designated by reference numeral 20, is connected to the body 12 and, more particularly, the handle assembly 16. A suction generator 22 and a dirt collection vessel 24 are carried on the body 12.

In the illustrated embodiment, the suction generator 22 and dirt collection vessel 24 are both carried on the handle assembly 16. However, either or both could be provided on the nozzle assembly 14 if desired. The dirt collection vessel 24 comprises a dirt cup 26 with a lid and handle 27. The dirt cup 26 includes a cylindrical outer wall 28, equipped with a tangentially directed inlet 30, and an axially directed outlet 32 covered by a filtering screen or shroud 34. This configuration comprises a primary cyclone for separating dirt and debris from the airstream. The airstream then passes through a secondary cyclone assembly, generally designated by reference numeral 36, which removes any remaining fine particle from the airstream before the airstream is exhausted from the dirt collection vessel 24 to travel by means of conduit to the suction generator 22.

It should be appreciated that other types of dirt collection vessels 24 may be provided on the vacuum cleaner 10 including simple dirt cups without cyclonic cleaning action as well as a standard state-of-the-art vacuum cleaner bag contained in a bag compartment within the body 12 of the vacuum cleaner 10.

Figure 4A:
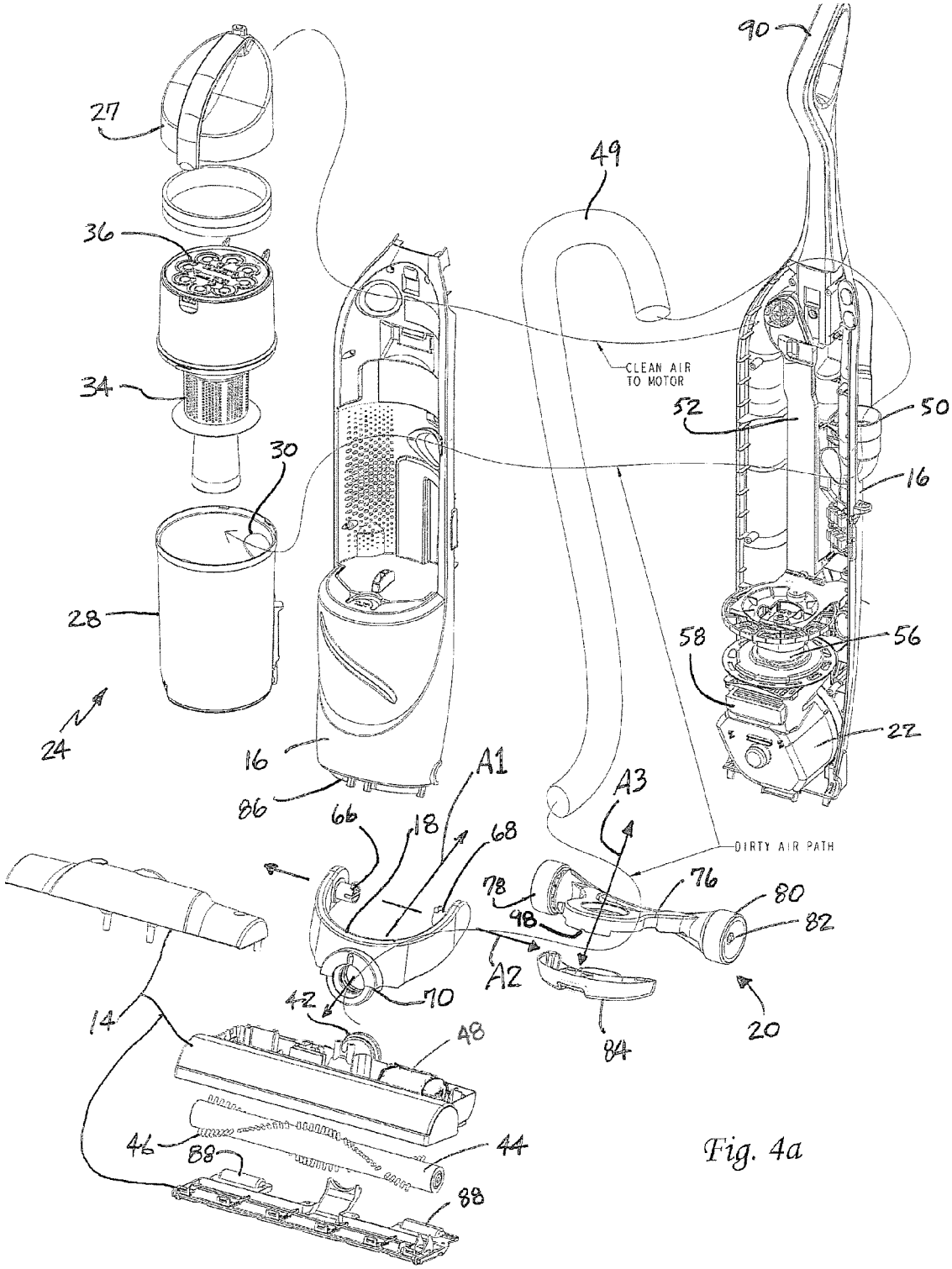
FIG. 4*a* is an exploded perspective view of the vacuum cleaner.
Figure 4B:
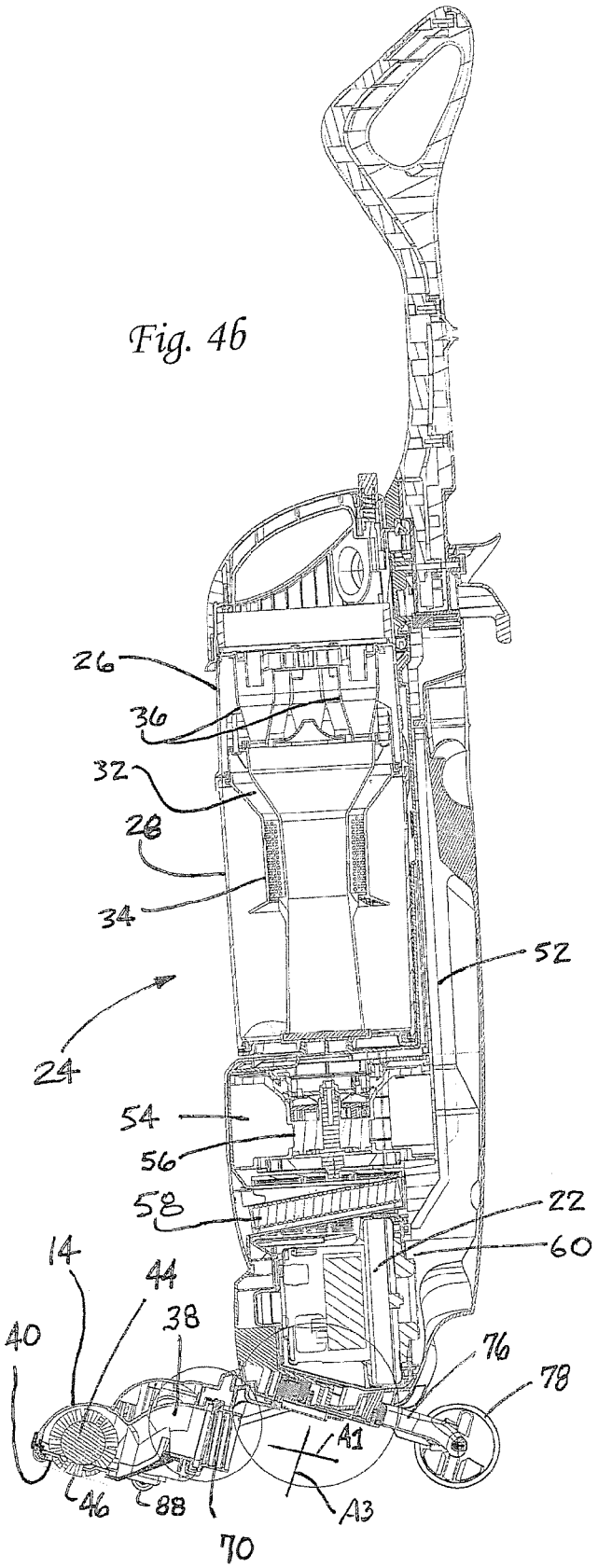
FIG. 4*b* is a cross sectional view of the vacuum cleaner.
Figure 4C:
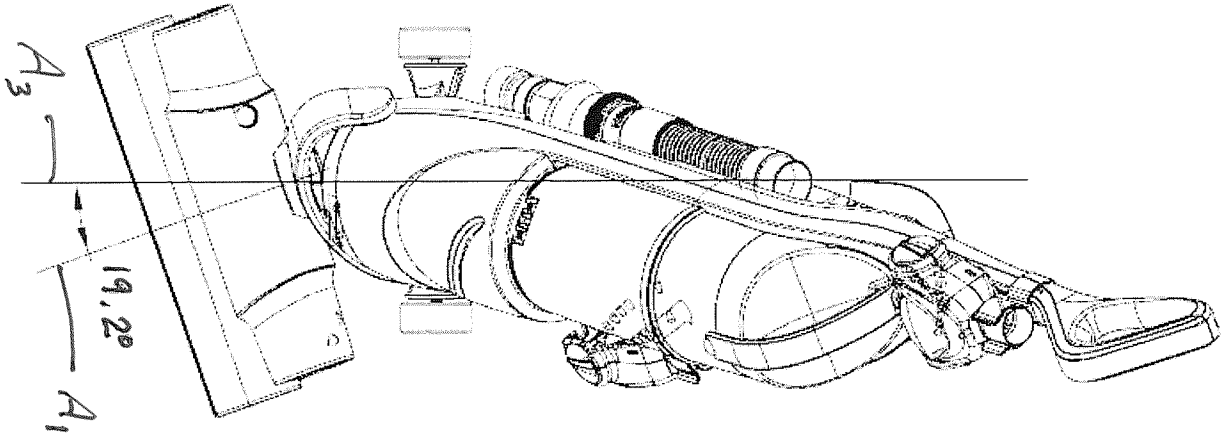
FIG. 4*c* is a perspective view showing the relationship of the third pivot axis with respect to the longitudinal axis of the handle assembly.

As best illustrated in FIGS. 4*a* and 4*b*, the nozzle assembly 14 includes an airstream conduit 38 having a suction inlet 40 at one end and an airstream outlet 42 at the other end. A rotary agitator 44 equipped with cleaning projections such as bristle tufts 46 is carried on the nozzle assembly and extends across a suction inlet 40. A dedicated agitator drive motor 48 is also carried on the nozzle assembly 14 and is operatively connected to the agitator by an appropriate power takeoff (not shown) such as a drive belt or gear arrangement.

During operation the rotary agitator 44 is driven by the agitator drive motor 48 at high speeds to beat dirt and debris from the nap of an underlying carpet to be cleaned. That dirt and debris is entrained in the airstream being drawn through the suction inlet 40 by the suction generator 22. The airstream with the entrained dirt and debris passes through the airstream outlet 42 and then travels through a flexible hose 49 to the airstream fitting 50 provided on the handle assembly 16. The fitting 50 directs the airstream into the tangentially directed inlet 30 of the dirt collection vessel 24. Dirt and debris in the airstream is captured in the dirt collection vessel 24 and relatively clean air is then exhausted from the dirt cup into the conduit 52 formed in the handle assembly 16. The conduit 52 delivers the airstream to the intake side of the suction generator 22. The airstream then passes through the motor of the suction generator 22 so as to provide cooling. Next, the airstream is exhausted through the final filter 58 into the cord reel compartment 54. There the airstream cools the cord reel 56 before being discharged through an exhaust port (not shown).

Reference is now made to FIGS. 1, 2, 4*a* and 7 illustrating the connector 18 that pivotally connects the nozzle assembly 14 to the handle assembly 16. The connector 18 is a dual pivot connector taking the form of a yolk having a first pivot 66 at a first end, a second pivot 68 at a second end and a third pivot 70 intermediate the first and second pivots 66, 68. As illustrated, the third pivot 70 (in the form of a locking ring) connects to the end of the airstream outlet 42 on the nozzle assembly 14 providing a first pivotal connection having a first pivot axis A1 (see particularly FIGS. 4*a* and 8). The hose 49 extends from the outlet 42 through the ring 70. The first and second pivots 66, 68 are opposed and form a trunnion which functions as a second pivotal connection with the handle assembly 16. The second pivotal connection has a second pivot axis A2 that is substantially perpendicular to the first pivot axis A1 (note particularly FIGS. 4*a* and 7). During operation, the second pivot axis A2 orbits about the first pivot axis A1 through an arc A of about 60 degrees (30 degrees in each direction from a centered position).

Reference is now made to FIGS. 4*a*, 4*b* and 6 illustrating the tilt axle assembly 20. The tilt axle assembly 20 comprises a frame, generally designated by reference numeral 76, and first and second wheels 78, 80 mounted on the frame for rotation with respect to the frame. The wheels 78, 80 may be secured to the frame by means of an axle 82. Alternatively, each wheel 78, 80 may be secured to a stub shaft of the frame 76. In either arrangement, the wheels 78, 80 rotate about a common wheel axis WA. A fastener 84 pivotally secures the frame 76 of the tilt axle assembly 20 to the base 86 of the handle assembly 16. The fastener or pivot pin 84 provides the third pivotal connection that forms the third pivot axis A3. As further illustrated in FIG. 2, the handle assembly 16 has a longitudinal axis LA.

Figure 2:
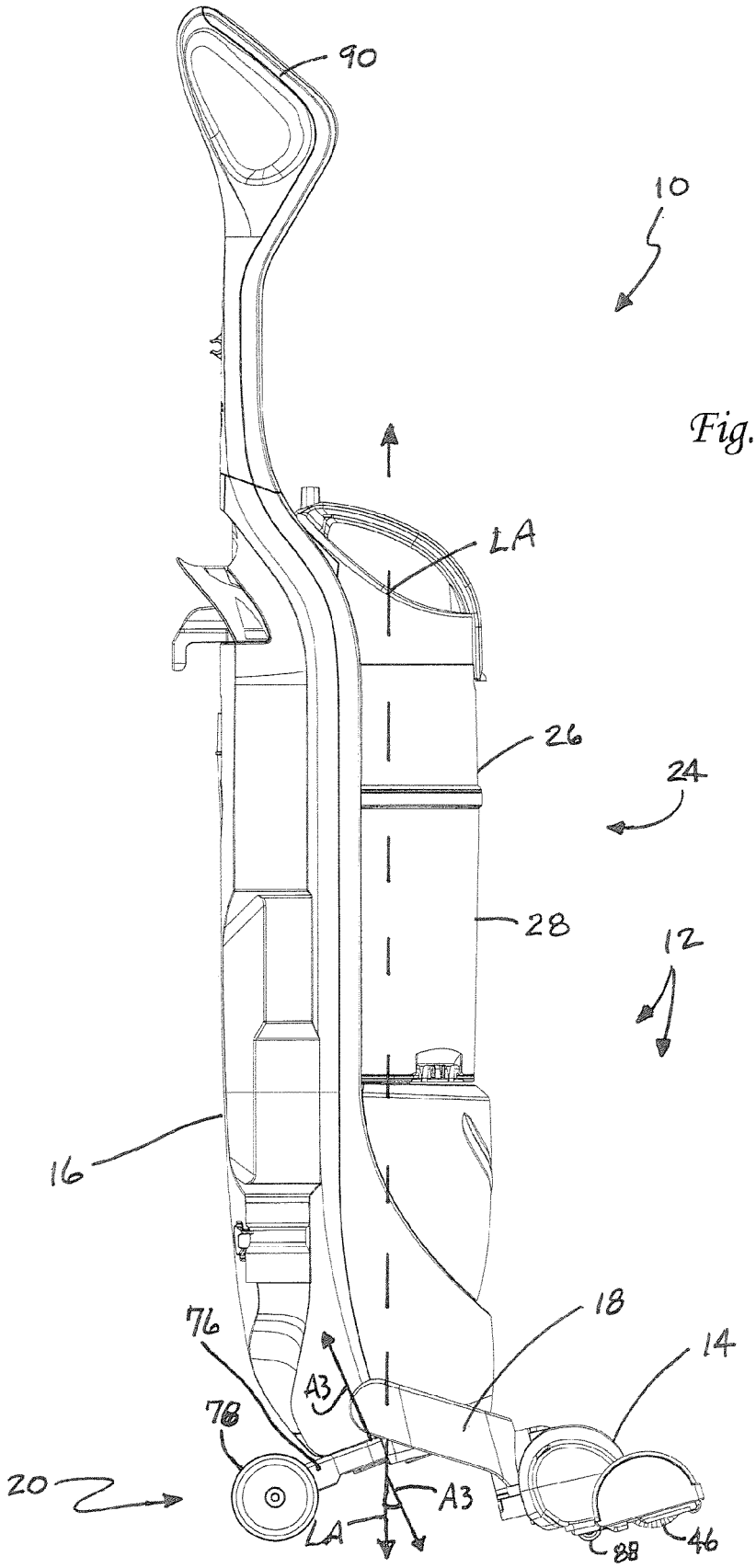
FIG. 2 is a right side elevational view of the vacuum cleaner illustrated in FIG. 1 with the handle in the upright, storage position.
Figure 3:
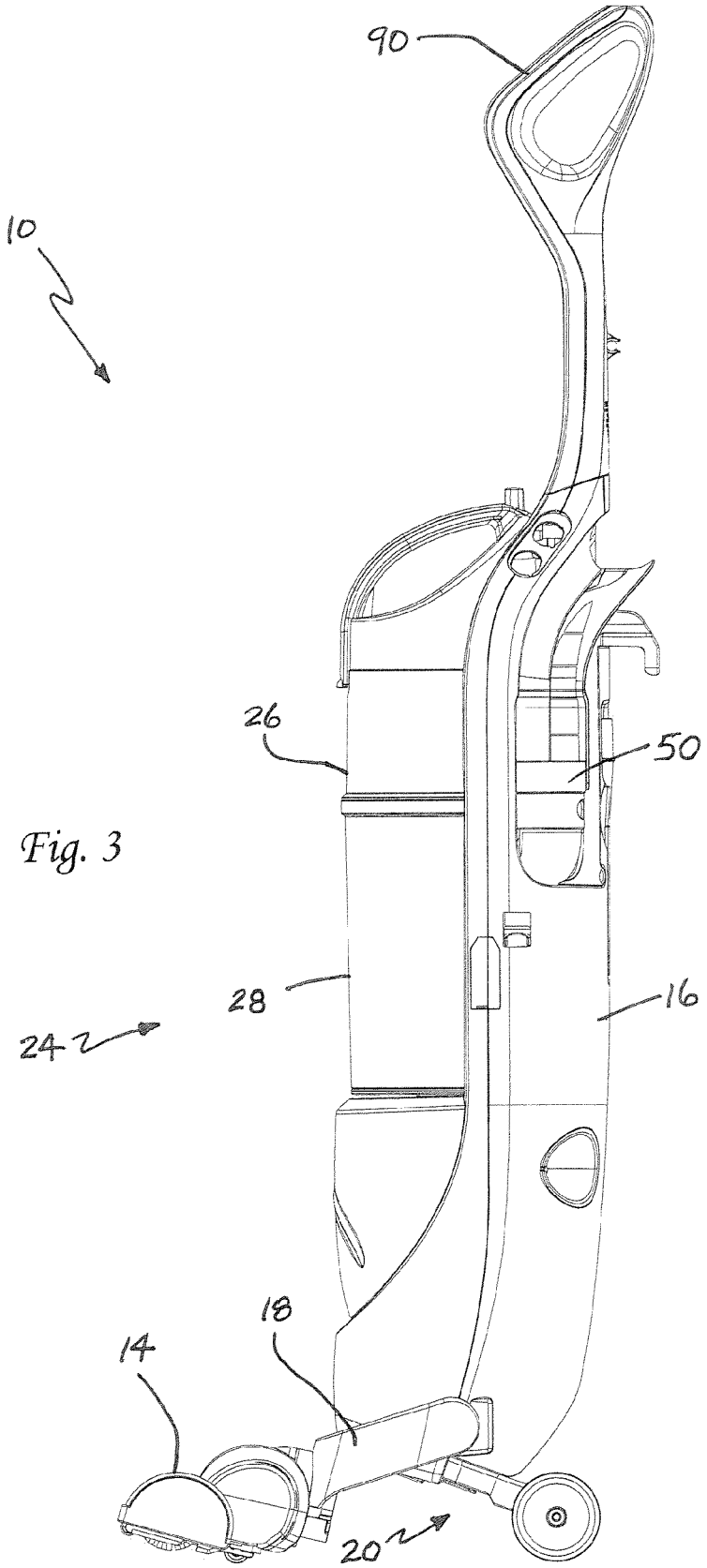
FIG. 3 is a left side elevational view.
Figure 5A:
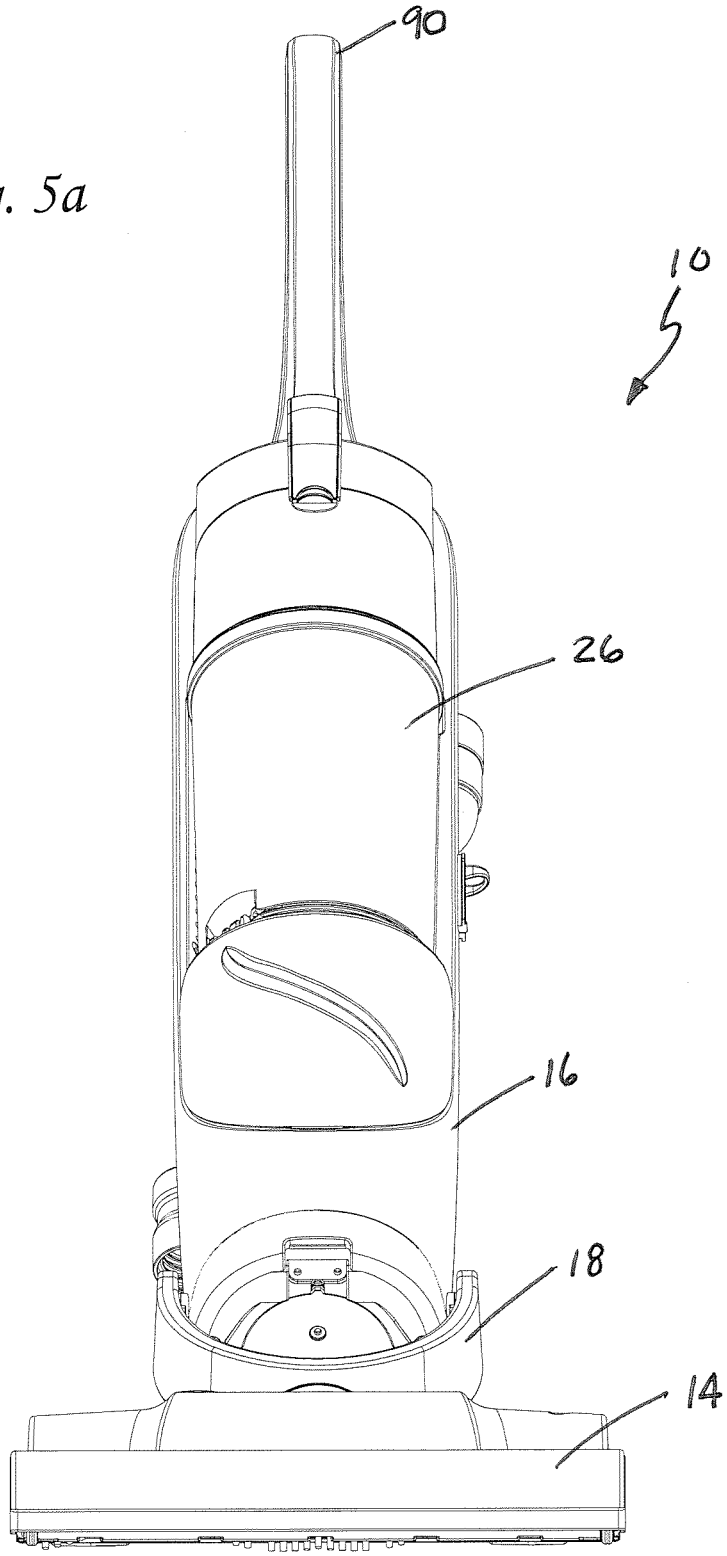
FIGS. 5*a*-5*c* are, respectively, front elevational views with the operating handle of the vacuum cleaner centered so as to steer the vacuum cleaner straight ahead, twisted so as to steer the vacuum cleaner to the right and twisted so as to steer the vacuum cleaner to the left.

As should be appreciated from viewing FIGS. 1-3, the vacuum cleaner 10 is supported for movement along an underlying floor F on the rear wheels 78, 80 carried on the tilt axle assembly 20 and the front wheels or rollers 88 carried for relative rotation on the nozzle assembly 14 adjacent the suction inlet 40. As best illustrated in FIG. 5*a*, when the operator wishes to move the vacuum cleaner 10 in a straight direction, the inclined handle assembly 16 including the handgrip 90 is aligned with the nozzle assembly 14. In this position the tilt axle assembly 20 also falls into alignment with the nozzle assembly 14.

Figure 5B:
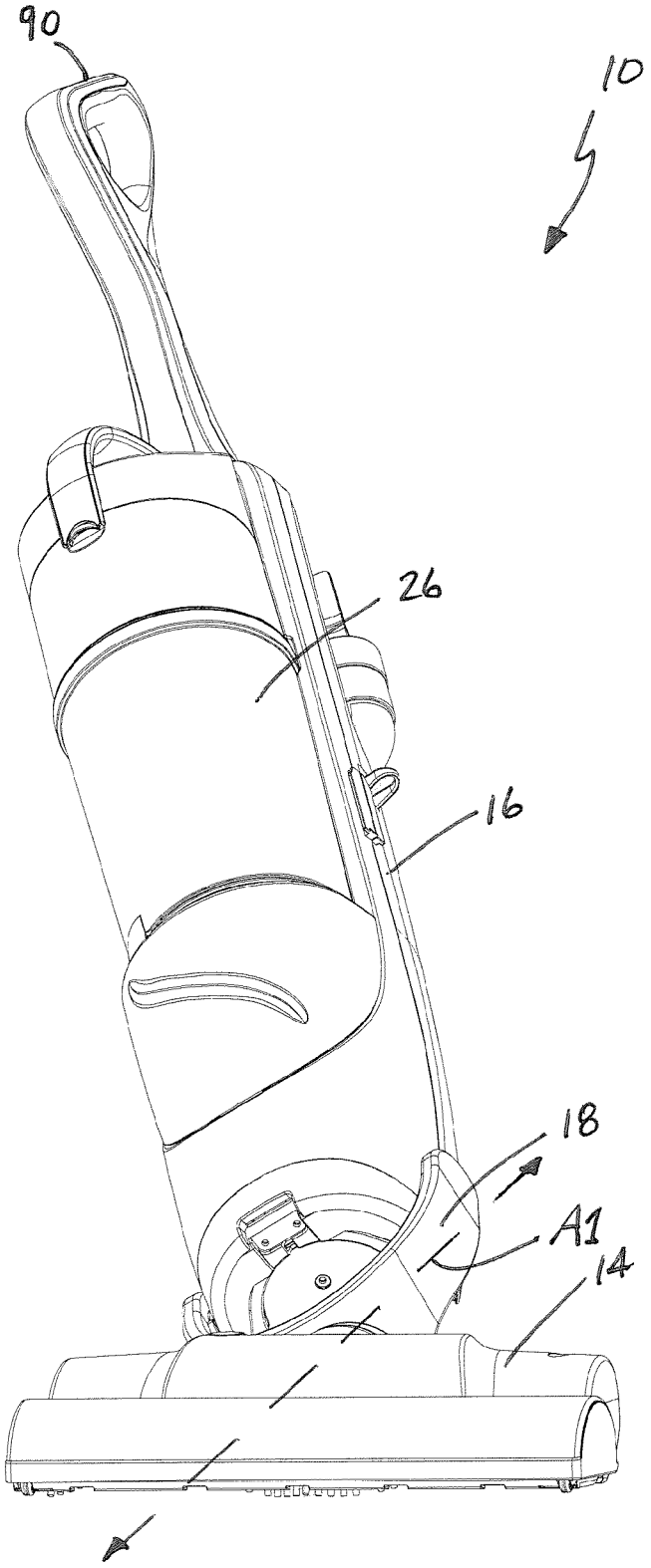
Figure 5C:
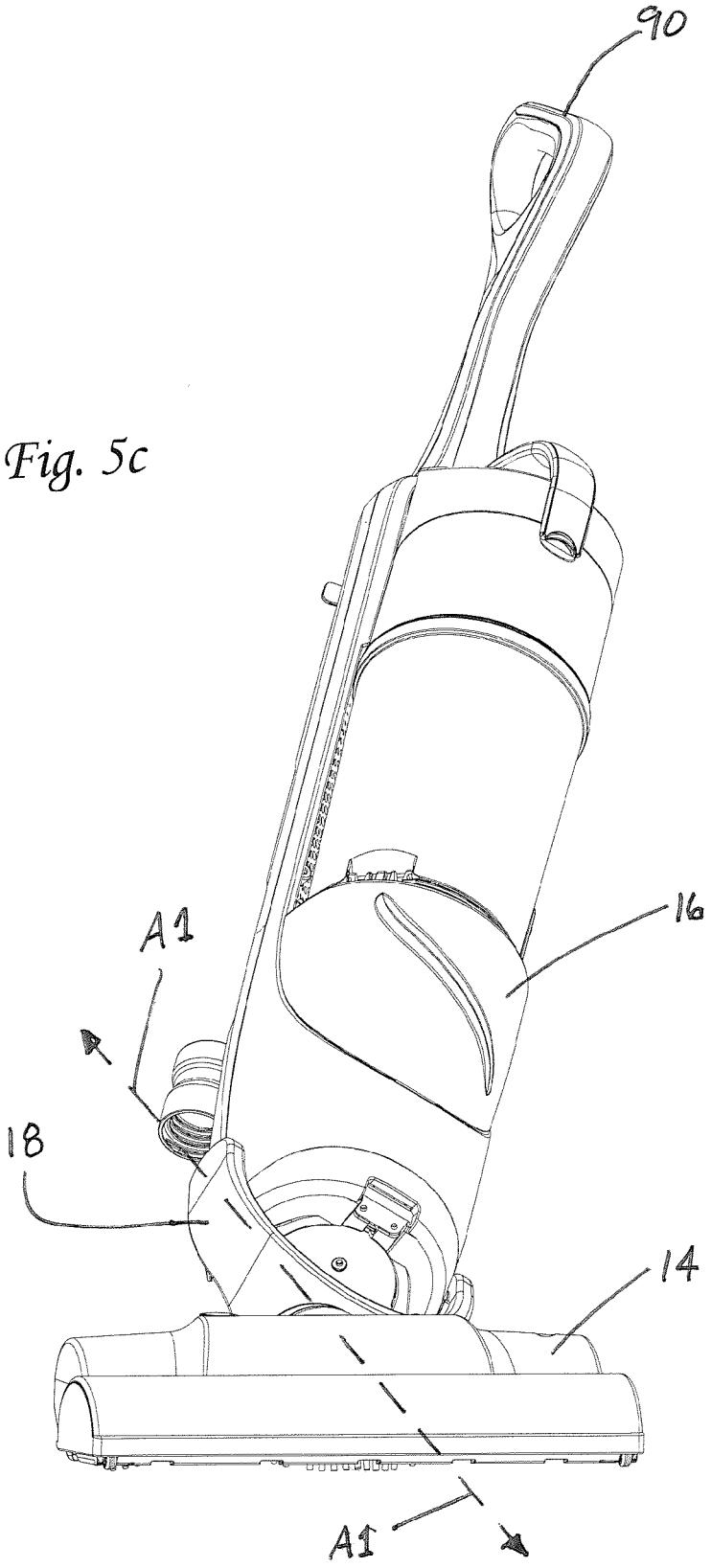
Figure 7:
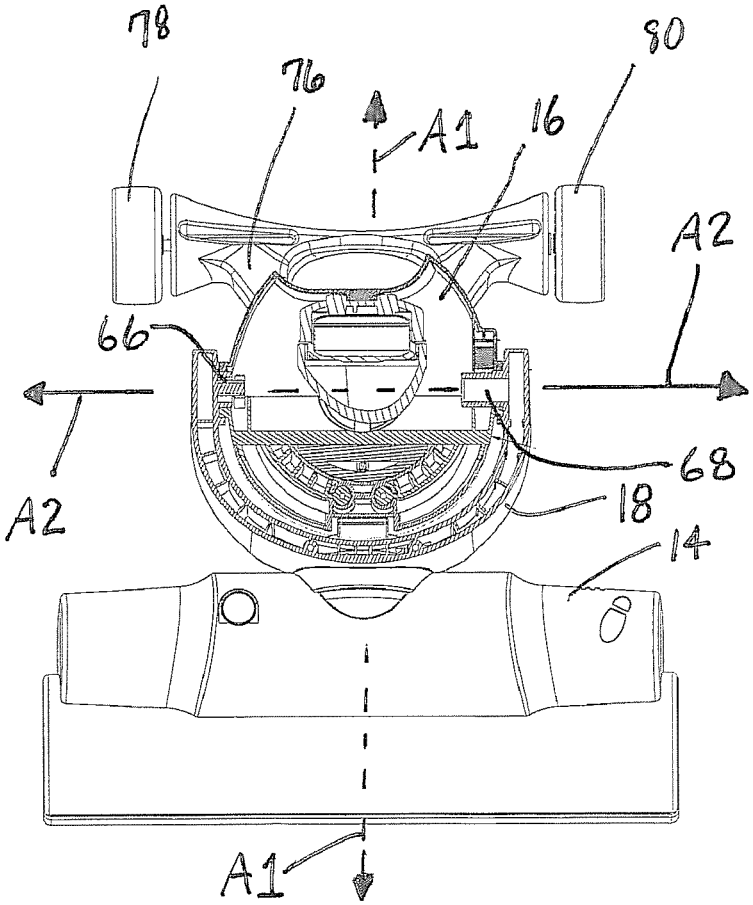
FIG. 7 is a detailed cross sectional view illustrating the pivotal connection between the yolk and the handle assembly.

In contrast, when the operator desires to turn the vacuum cleaner 10 to the right, the operator twists the hand grip 90 and handle assembly 16 to the right as illustrated in FIG. 5*b* about the first pivot axis A1. This tips the nozzle assembly 14 to the right and provides an optimum attack angle so that as the operator presses forward on the handgrip 90 the vacuum cleaner turns smoothly and quickly to the right. Advantageously, the tilt axle assembly 20 simultaneously pivots about the third pivot axis A3 to bring the wheels 78, 80 carried thereon into proper alignment to cut a smooth clean arc to turn the vacuum cleaner more efficiently.

In contrast, when the operator desires to turn the vacuum cleaner 10 to the left, the operator twists the hand grip 90 and handle assembly 16 to the left about the pivot axis A1. This tips the nozzle assembly 14 to the left and provides an optimum attack angle for the operator to push the vacuum cleaner in that direction. Once again, it should be appreciated that the tilt axle assembly 20 simultaneously pivots about the pivot axis A3 with respect to the handle assembly 16 so as to align the wheels 78, 80 on the tilt axle assembly to cut a smooth and efficient arc in that direction.

Figure 11:
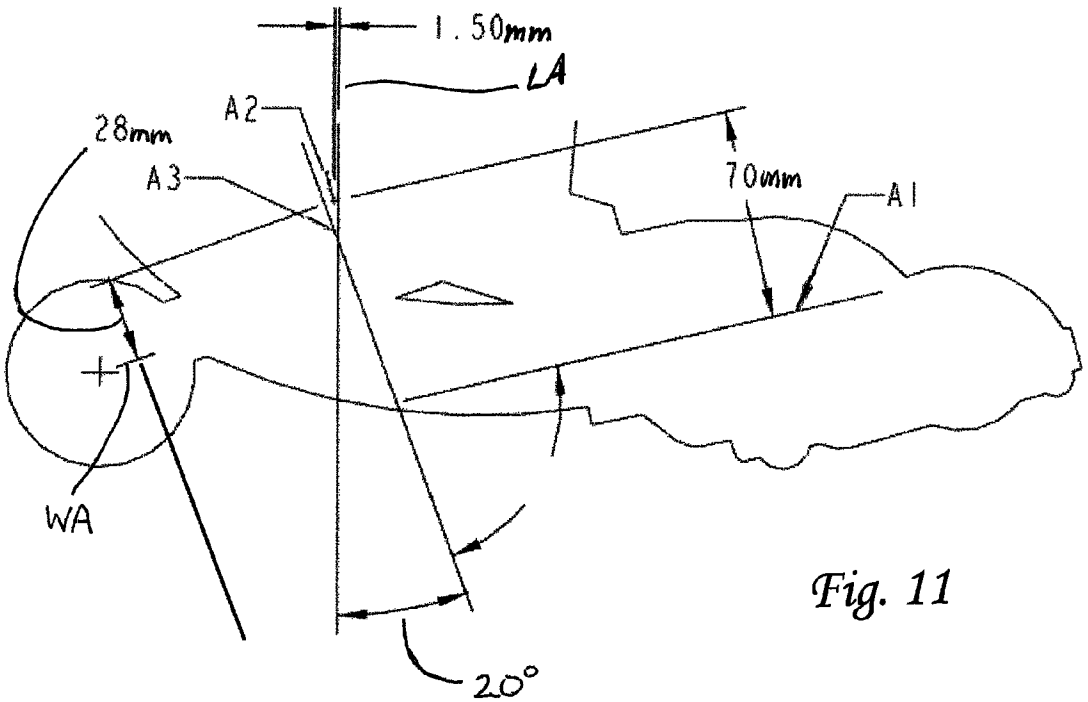
FIG. 11 is a schematical illustration of the geometry of the various axes of the vacuum cleaner.

Here it should be appreciated that the particular geometry of the various axes LA, $A_1$, $A_2$, $A_3$ and WA combine to provide the most effective attack angle for the operator to ensure maximum maneuverability and steering efficiency with the least amount of effort. More specifically, as best illustrated in FIG. 11, axis $A_2$ is offset from axis $A_1$ a distance of between 60 and 80 mm (eg 70 mm) as measured along a line perpendicular to axis $A_1$. Axis $A_2$ is offset from axis WA of the wheels 78, 80 a distance of between 26 and 30 mm (eg 28 mm) as measured along a line perpendicular to the axis WA and substantially parallel to axis $A_3$. In addition, axis $A_3$ forms an included angle of between 10 and 30 degrees (eg 20 degrees) with the longitudinal axis LA of the handle assembly 16. Still further, axis $A_3$ is provided about 1.5 mm in front of Axis $A_2$ (i.e. toward the rotary agitator 44).

Figure 9A:
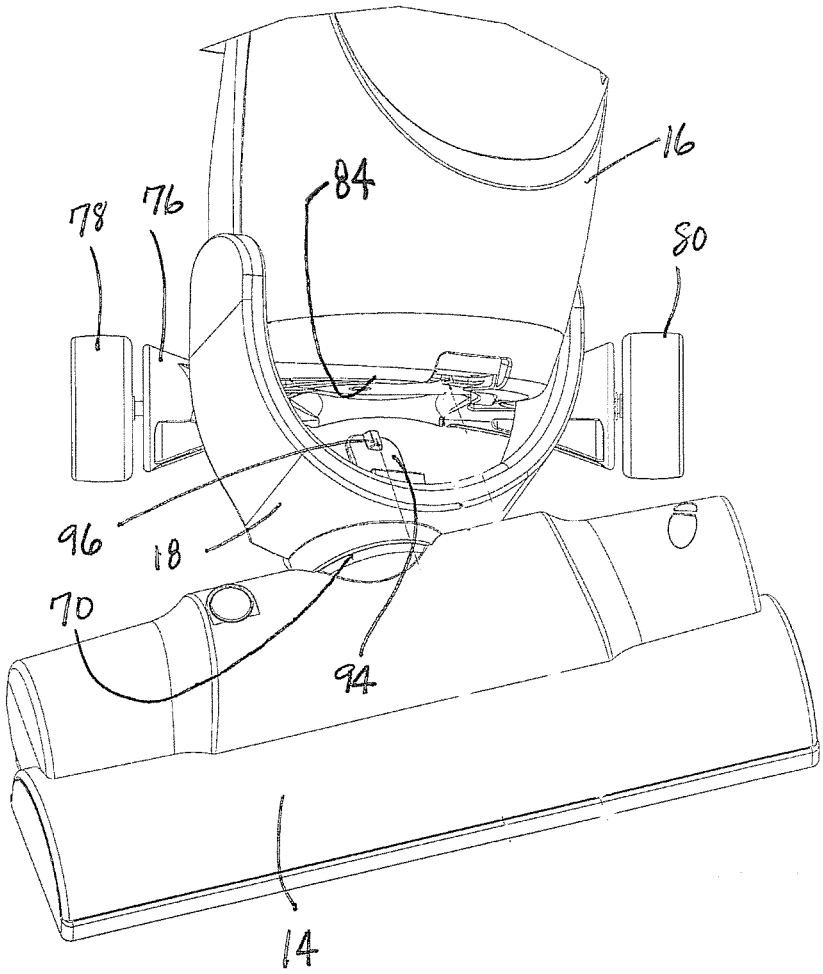
Figure 96:
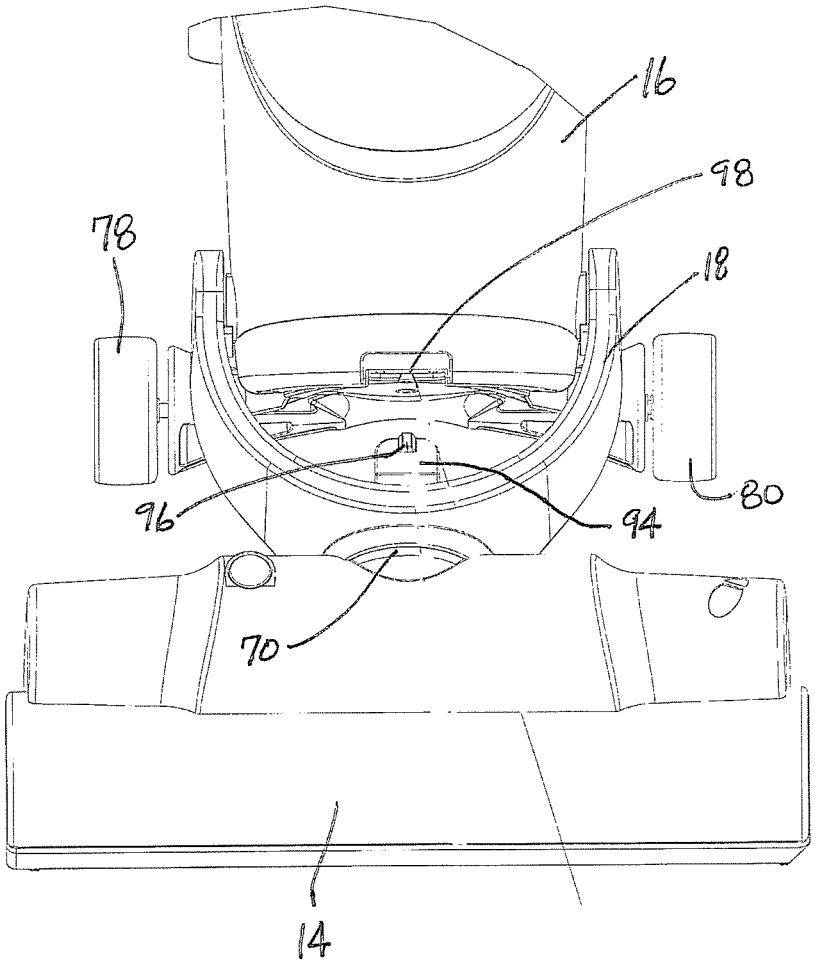
Figure 10A:
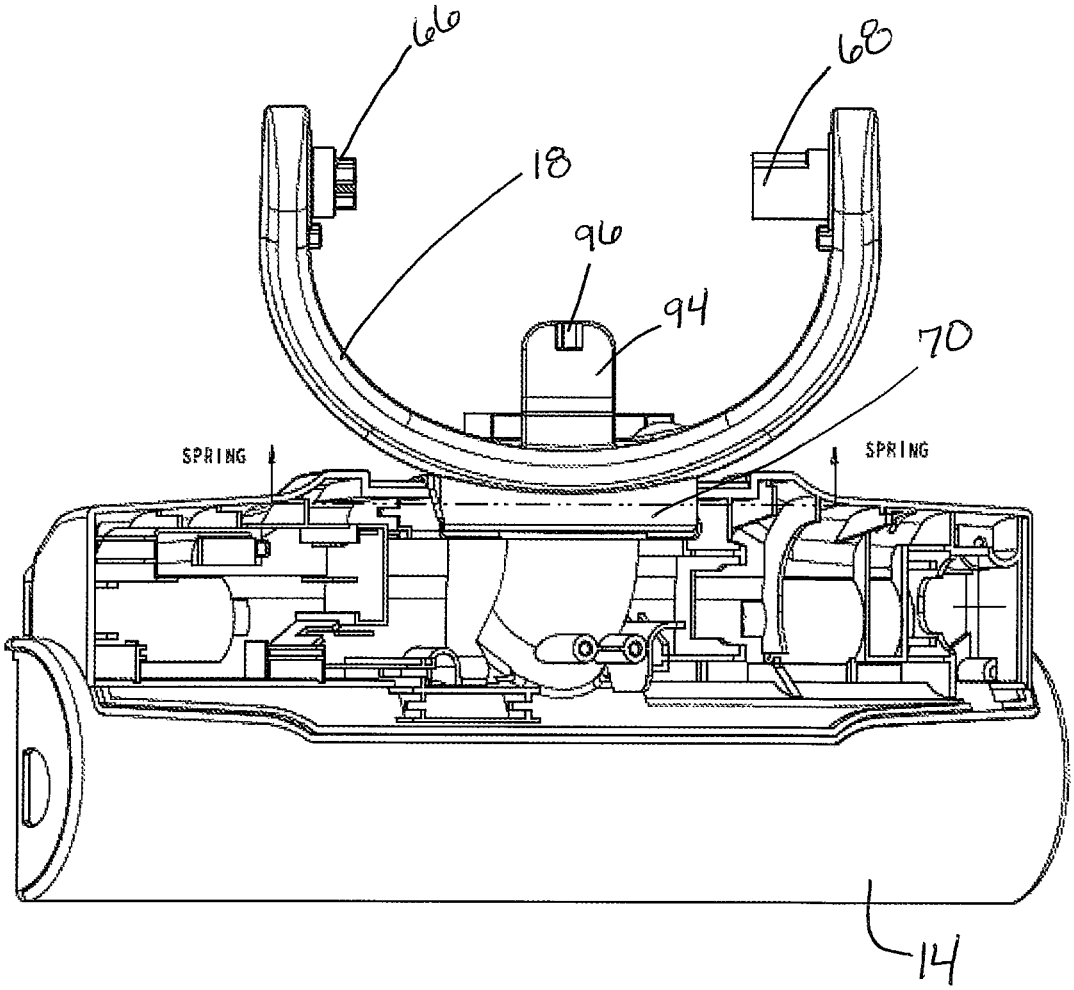
FIGS. 10*a*-10*c* are, respectively, detailed top plan and two detailed cross sectional views illustrating operation of the centering spring and showing the nozzle assembly in a centered and an angled position.

Advantageously, the enhanced maneuverability and effortless control are achieved without detrimental tradeoffs. As should be appreciated, the suction generator 22 with its high speed motor is held in the handle assembly 16 where the torque produced by that motor does not interfere with the maneuvering of the vacuum cleaner 10. Further, the geometry and wide stance of the wheels 78, 80 of the tilt axle assembly 20 ensure the stability of the vacuum cleaner 10 when the handle assembly 16 is positioned in the upright storage position illustrated in FIGS. 1-3. More particularly, as illustrated in FIGS. 9*a*, 9*b* and 10*a*, a flexible centering post 94 with a tab 96 projects from the connector 18 adjacent the third pivot 70. A cooperating locking notch 98 located in the frame 76 is given access through fastener 84. As illustrated in FIG. 9*a*, when the handle assembly 16 is pivoted about the second pivot axis A2 into an inclined operating position, the locking notch 98 is free of the flexible centering post 94 and there is no interference with the turning function of the vacuum cleaner 10. As illustrated in FIG. 9*b*, when the handle assembly 16 is twisted to align the handle assembly with the nozzle assembly 14, the locking notch 98 in the frame 76 of the tilt axle assembly 20 is brought into alignment with the flexible centering post 94. When the handle assembly 16 is then pivoted completely forward about the second pivot axis A2, the tab 96 is guided toward and received in the locking notch 98 to secure the tilt axle assembly so that the longitudinal axis LA is perpendicular to the axis of the axle 82 in the upright storage position illustrated in FIGS. 1-3 (see also the engagement of the tab 96 in the notch 98 as illustrated in FIG. 6). This is also helpful in the transport mode when the vacuum cleaner is tilted rearwardly on the wheels 78, 80 so as to lift the nozzle assembly 14 from contacting the underlying floor.

Figure 10B:
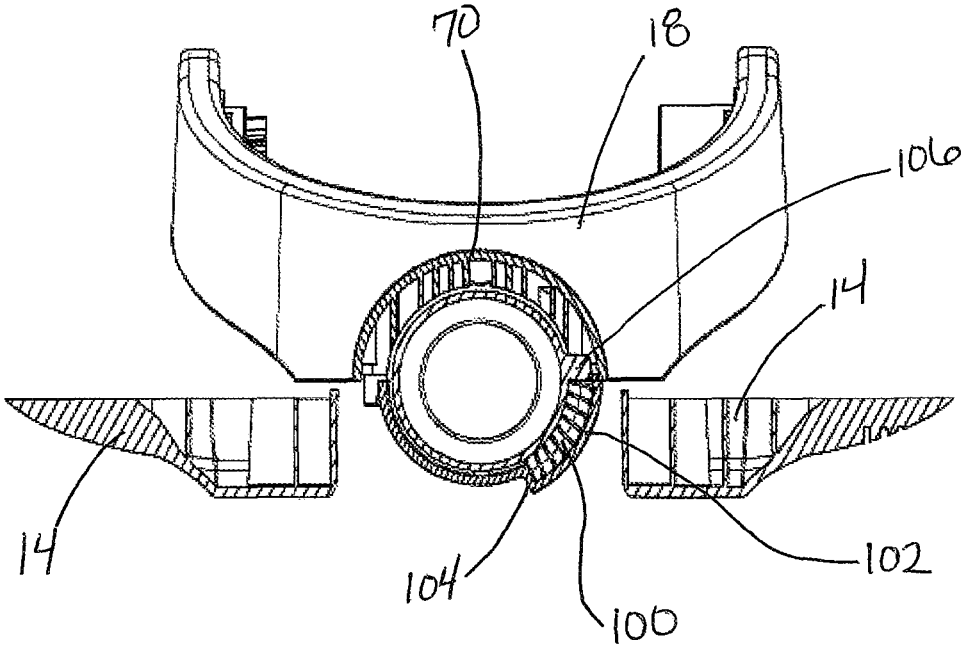
Figure 10C:
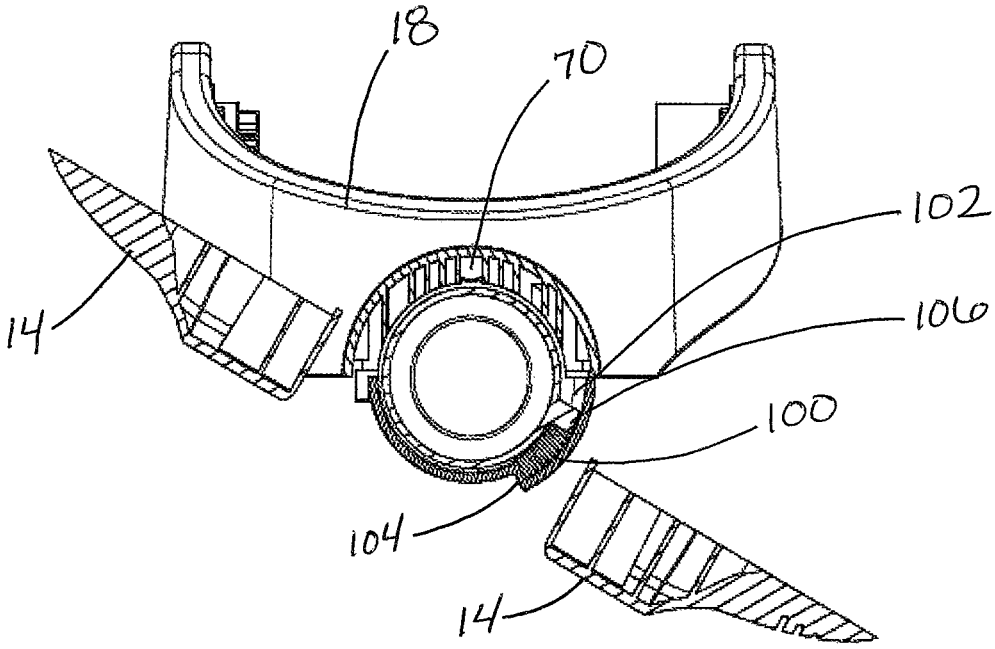

As best illustrated in FIGS. 8, 10*b* and 10*c*, the vacuum cleaner 10 also includes a mechanism for centering the nozzle assembly 14 with respect to the handle assembly 16 when the vacuum cleaner is tilted rearwardly on the wheels 78, 80 so as to lift the nozzle assembly from contact with the underlying floor. As illustrated, the first pivotal axis A1 formed by the third pivot or locking ring 70 between the connector 18 and the nozzle assembly 14 includes a spring 100. The spring 100 is held in a cavity 102 formed in the locking ring 70 of the connector 18. The spring 100 has a first end that engages against an end wall 104 of the cavity 102 and a second end that engages a lug 106 formed on the nozzle assembly 14. As illustrated in FIG. 10*c*, if the nozzle assembly 14 is pivoted about the first pivot axis A1 with respect to the connector 18, the spring 100 is compressed. The compressed spring 100 functions to bias the nozzle assembly 14 back to the center position illustrated in FIG. 10*b*. Pivoting of the nozzle assembly 14 in the opposite direction relieves the spring from contact with lug 106 and has no effect on the centering mechanism. The spring is designed to counter the weight of the agitator drive motor 48, keeping the nozzle assembly 14 horizontal when the cleaner is tilted rearwardly on the wheels 78, 80 so as to lift the nozzle assembly from contact with the underlying floor.

The foregoing description of the preferred embodiments of the present invention have been presented for purposes of illustration and description. It is not intended to be exhaustive or to limit the invention to the precise form disclosed. Obvious modifications or variations are possible in light of the above teachings. The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims in their fair and broad interpretation in any way.

What is claimed:

1. An upright vacuum cleaner, comprising:

a body including a nozzle assembly and a handle assembly;

a suction generator carried on said body;

a dirt collection vessel carried on said body;

a connector connecting said handle assembly and said nozzle assembly, said connector providing a first pivotal connection between said connector and said nozzle assembly and a second pivotal connection between said connector and said handle assembly; and a tilt axle assembly connected to said handle assembly by a third pivotal connection.

2. The vacuum cleaner of claim 1, wherein said nozzle assembly includes a suction inlet.

3. The vacuum cleaner of claim 2, further including a rotary agitator carried on said nozzle assembly and extending across said suction inlet.

4. The vacuum cleaner of claim 1, wherein said dirt collection vessel is a dirt cup.

5. The vacuum cleaner of claim 4, wherein said dirt cup includes a tangentially directed inlet and an axially directed outlet.

6. The vacuum cleaner of claim 5, further including a filter over said axially directed outlet.

7. The vacuum cleaner of claim 1, wherein said dirt collection vessel is a vacuum cleaner bag held in a bag compartment in said body.

8. The vacuum cleaner of claim 1, wherein said first pivotal connection has a first pivot axis and said second pivotal connection has a second pivot axis where said second pivot axis is offset from said first pivot axis a distance of between 60 mm and 80 mm as measured along a line perpendicular to said first pivot axis.

9. The vacuum cleaner of claim 8, wherein said second pivot axis orbits about said first pivot axis through an arc A.

10. The vacuum cleaner of claim 9, wherein said arc A has an extent of about 60 degrees.

11. The vacuum cleaner of claim 8, wherein said connector comprises a yoke having a first pivot at a first end, a second pivot at a second end and a third pivot intermediate said first and second pivots.

12. The vacuum cleaner of claim 11, wherein said first and second pivots are opposed so as to form a trunnion defining said second pivot axis.

13. The vacuum cleaner of claim 1, wherein said tilt axle assembly comprises a frame, a first wheel mounted on said frame for rotation with respect to said frame, a second wheel mounted on said frame for rotation with respect to said frame and a pivot pin for pivotally securing said frame to said handle assembly, said pivot pin providing said third pivotal connection and said third pivotal connection having a third pivot axis.

14. The vacuum cleaner of claim 13, wherein said first wheel and said second wheel both rotate about a common wheel axis and said second pivot axis is offset from said wheel axis a distance of between 26 and 30 mm as measured along a line perpendicular to said wheel axis and substantially parallel to said third pivot axis.

15. The vacuum cleaner of claim 14, wherein said handle assembly has a longitudinal axis, said third pivot axis and said longitudinal axis forming an included angle of between about 10 and about 30 degrees.

16. The vacuum cleaner of claim 14, wherein said handle assembly has a longitudinal axis, said third pivot axis and said longitudinal axis forming an included angle of about 20 degrees.

17. The vacuum cleaner of claim 1, wherein said first pivotal connection has a first pivot axis and said second pivotal connection has a second pivot axis where said second pivot axis is offset from said first pivot axis a distance of about 70 mm as measured along a line perpendicular to said first pivot axis.

18. The vacuum cleaner of claim 17, wherein said tilt axle assembly comprises a frame, a first wheel mounted on said frame for rotation with respect to said frame, a second wheel mounted on said frame for rotation with respect to said frame and a pivot pin for pivotally securing said frame to said handle assembly, said pivot pin providing said third pivotal connection and said third pivotal connection having a third pivot axis.

19. The vacuum cleaner of claim 18, wherein said first wheel and said second wheel both rotate about a common wheel axis and said second pivot axis is offset from said wheel axis a distance of about 28 mm as measured along a line parallel to said third pivot axis.

20. The vacuum cleaner of claim 19, wherein said handle assembly has a longitudinal axis, said third pivot axis and said longitudinal axis forming an included angle of about 20 degrees.

21. The vacuum cleaner of claim 20 wherein said third pivot axis is provided about 1.5 mm in front of said second pivot axis.

22. The vacuum cleaner of claim 1, further including at least one front wheel carried on said nozzle assembly and at least two rear wheels carried on said tilt axle assembly.

23. The vacuum cleaner of claim 1, wherein said first pivotal connection includes a spring for centering said nozzle assembly with respect to said handle assembly when said nozzle assembly is lifted from contact with the floor.

24. The vacuum cleaner of claim 1, further including a centering post on said connector and a cooperating locking notch on said handle assembly, said centering post being received in said locking notch so as to positively hold said handle assembly in an upright, storage position.

* * * * *